US009957647B2

(12) United States Patent
Date et al.

(10) Patent No.: US 9,957,647 B2
(45) Date of Patent: May 1, 2018

(54) FALSE-TWISTED LOW-FUSED POLYESTER YARN AND MULTILAYER-STRUCTURE WOVEN OR KNITTED FABRIC

(71) Applicant: Toray Industries, Inc., Tokyo (JP)

(72) Inventors: Hiroaki Date, Otsu (JP); Naoki Oda, Tokyo (JP); Tomoko Ito, Otsu (JP); Kouji Nishiya, Inazawa (JP)

(73) Assignee: Toray Industries, Inc. (JP)

( * ) Notice: Subject to any disclaimer, the term of this patent is extended or adjusted under 35 U.S.C. 154(b) by 412 days.

(21) Appl. No.: 14/409,331

(22) PCT Filed: Jun. 21, 2013

(86) PCT No.: PCT/JP2013/067128

§ 371 (c)(1),
(2) Date: Dec. 18, 2014

(87) PCT Pub. No.: WO2013/191284

PCT Pub. Date: Dec. 27, 2013

(65) Prior Publication Data

US 2015/0167206 A1 Jun. 18, 2015

(30) Foreign Application Priority Data

Jun. 22, 2012 (JP) ..... 2012-140898

(51) Int. Cl.
*D02G 3/44* (2006.01)
*D03D 11/00* (2006.01)
(Continued)

(52) U.S. Cl.
CPC ..... *D02G 3/44* (2013.01); *D02G 1/0206* (2013.01); *D02G 1/0253* (2013.01); *D02G 3/02* (2013.01);
(Continued)

(58) Field of Classification Search
CPC ..... D02G 3/44; D02G 3/30; D02G 1/0253; D02G 1/0206; D02G 1/02; D02G 1/028; D01H 1/10
(Continued)

(56) References Cited

U.S. PATENT DOCUMENTS 3,877,213 A * 4/1975 MacFarlane ..... D02G 1/022 57/247
3,932,986 A * 1/1976 Kosaka ..... D02G 1/024 57/205
(Continued)

FOREIGN PATENT DOCUMENTS

GB 1 460 865 1/1977
JP 54-82464 6/1979
(Continued)

OTHER PUBLICATIONS

Supplementary European Search Report dated Feb. 19, 2016, of corresponding European Application No. 13806149.4.

*Primary Examiner* — Shaun R Hurley
*Assistant Examiner* — Bao-Thieu L Nguyen
(74) *Attorney, Agent, or Firm* — DLA Piper LLP (US)

(57) ABSTRACT

A false-twisted low-fused polyester yarn has a non-untwisted part having a twist in a false-twist direction, an over-untwisted part having a twist in a direction opposite to the false-twist direction, and a non-twisted crimped part having no twist, alternately disposed along the longitudinal direction of the yarn, the average length of the non-untwisted part being no more than 7 mm, the average length of the over-untwisted part being at least 7 mm, and the degree of fusion-bonding in the yarn longitudinal direction being no more than 50%.

17 Claims, 1 Drawing Sheet

(51) Int. Cl.

| | |
|---|---|
| ***D03D 15/00*** | (2006.01) |
| ***D02G 1/02*** | (2006.01) |
| ***D04B 1/16*** | (2006.01) |
| ***D02G 3/02*** | (2006.01) |
| ***D02G 3/30*** | (2006.01) |
| ***D02G 3/34*** | (2006.01) |

(52) U.S. Cl.
CPC ..... *D02G 3/30* (2013.01); *D02G 3/34* (2013.01); *D03D 11/00* (2013.01); *D03D 15/00* (2013.01); *D03D 15/0083* (2013.01); *D04B 1/16* (2013.01); *D10B 2331/04* (2013.01); *D10B 2401/022* (2013.01); *D10B 2401/04* (2013.01); *D10B 2403/011* (2013.01); *Y10T 442/3098* (2015.04); *Y10T 442/431* (2015.04)

(58) Field of Classification Search
USPC ..... 57/208, 332
See application file for complete search history.

(56) References Cited

U.S. PATENT DOCUMENTS 3,967,441 A * 7/1976 Yasuzuka ..... D02G 3/22 57/2
3,977,173 A * 8/1976 Kosaka ..... D02G 1/0253 57/205
4,033,103 A * 7/1977 Vukoje ..... D02G 1/024 57/205
4,070,815 A * 1/1978 Negishi ..... D02J 1/08 28/252
4,103,481 A * 8/1978 Vukoje ..... D02G 1/024 57/205
4,164,839 A * 8/1979 Schweizer ..... D02G 3/36 57/293
4,307,565 A * 12/1981 Sasaki ..... D02G 1/0246 57/2
4,342,189 A * 8/1982 Negishi ..... D01D 5/20 28/246
RE31,376 E * 9/1983 Sheehan ..... D02G 1/165 28/274
4,402,178 A * 9/1983 Negishi ..... D02G 1/024 57/205
4,497,167 A * 2/1985 Nakahara ..... D01H 1/115 57/328
4,523,428 A * 6/1985 Negishi ..... D02G 1/024 57/205
4,561,244 A * 12/1985 Turk ..... D01H 7/923 57/336
4,578,940 A * 4/1986 Negishi ..... D02G 1/0213 57/208
4,638,624 A * 1/1987 Hakoyama ..... D02G 1/06 57/208
4,689,944 A * 9/1987 Toki ..... D02G 3/402 57/208
4,969,322 A * 11/1990 Sasaki ..... D02G 1/0286 28/156
4,976,097 A * 12/1990 Yanagihara ..... D01H 1/115 57/208
5,358,767 A * 10/1994 Bompard ..... B29C 70/16 428/371
5,414,987 A * 5/1995 Knoff ..... D02G 1/12 28/221
5,459,991 A * 10/1995 Nabeshima ..... D02G 1/0206 57/284
5,462,790 A * 10/1995 Matsuki ..... D02G 1/0286 428/397
5,993,944 A * 11/1999 Honna ..... B32B 5/26 428/151
6,244,031 B1 * 6/2001 Murakami ..... D01H 1/18 28/249
6,399,194 B1 * 6/2002 Kunisada ..... D02G 1/02 428/357
6,408,607 B1 * 6/2002 Nolle ..... D02G 1/024 57/205
6,477,828 B1 * 11/2002 Nolle ..... D02G 1/024 57/332
6,672,047 B2 * 1/2004 Howell ..... D01F 6/62 57/284
6,800,019 B2 * 10/2004 Tanaka ..... B24B 37/042 428/903
6,905,524 B2 * 6/2005 Hartgrove ..... D06P 1/228 8/494
7,581,376 B2 * 9/2009 Simmonds ..... D02G 1/161 57/333
8,388,588 B2 * 3/2013 Wada ..... A61F 5/451 604/317
8,580,362 B2 * 11/2013 Van Den Eede ... A61L 26/0019 428/34.1
8,685,537 B2 * 4/2014 Imai ..... C08J 5/04 264/257
8,689,362 B2 * 4/2014 Lavin ..... A41D 13/0512 2/468
9,127,380 B2 * 9/2015 Iwashita ..... D02G 1/02
2013/0089718 A1 * 4/2013 Schaefer ..... D06N 3/0013 428/206
2014/0360145 A1 * 12/2014 Hamada ..... D21H 27/08 55/482

FOREIGN PATENT DOCUMENTS

| | | |
|---|---|---|
| JP | 61-47838 | 3/1986 |
| JP | 63-21939 | 1/1988 |
| JP | 6-73630 | 3/1994 |
| JP | 7-157931 | 6/1995 |
| JP | 8-100340 | 4/1996 |
| JP | 10-273836 | 10/1998 |
| JP | 2000-303287 | 10/2000 |
| JP | 2007-162180 | 6/2007 |
| JP | 2008-121179 | 5/2008 |
| JP | 2014-210988 | 11/2014 |

* cited by examiner

FALSE-TWISTED LOW-FUSED POLYESTER YARN AND MULTILAYER-STRUCTURE WOVEN OR KNITTED FABRIC

TECHNICAL FIELD

This disclosure relates to a false-twisted low-fused polyester yarn and a multilayer-structure woven or knitted fabric made with the same, the yarn being capable of preparing a woven or knitted fabric excellent in water absorbability for quick-drying and breathability to provide a soft material having a unique surface.

BACKGROUND

As disclosed in JP-S54-82464-A, JP-S61-47838-A, JP-H6-73630-A and JP-H10-273836-A, false-twisted yarns which are partially fusion-bonded with thermoplastic synthetic fiber multi filaments have been developed to provide woven or knitted fabric with good tension and stiffness or cool texture (nonsticky cool feeling with hardness and snapping back when grasped). These materials have long fusion-bonded parts as well as hard texture with the cool texture.

JP 2007-162180-A and JP 2000-303287-A suggest that the fusion-bonded part of twisted or untwisted yarn should be designed to be longer or shorter or that the length ratio of the fusion-bonded part should be adjusted so that the cool texture is designed desirably into a strong cool texture with hemp feeling or a weak cool texture with swell or stretch.

JP-S63-21939-A discloses a fusion-bonded polymer fiber and another polymer of having a different melting point and modified cross section fusion-bonded as keeping the modified cross section to achieve appropriate cool texture, drape, flexibility and water retention simultaneously.

JP-H8-100340-A discloses a study of shortening the fusion-bonded part to achieve figured grain reduction and soft texture. However, if a strongly fusion-bonded part is damaged to shorten, processed yarn might have a low sectional porosity at the fusion-bonded part and be unstable in quality.

Conventional false-twisted fused yarns might have rough surface of special yarn structure substantively consisting of non-untwisted part, over-untwisted part and crimped part in a woven or knitted fabric, and might have a cool texture without softness and cannot easily be used for materials to contact skins.

Material for summer items should function to absorb sweat and to dry quickly. However, conventional yarns might be thick with constituent single yarns leaving narrow voids among the single yarns to cause a poor permeability and poor absorbability of water.

The improvement of water retention disclosed in JP-S63-21939-A requires a plurality of raw yarns or special raw yarns so that the cost might be raised and the quality control or surface might deteriorate.

Accordingly, it could be helpful to provide a material used for woven or knitted fabrics having a high water absorbability for quick-drying and breathability.

SUMMARY

We thus provide a false-twisted low-fused polyester yarn, comprising a non-untwisted part having a twist in a false-twist direction, an over-untwisted part having a twist in a direction opposite to the false-twist direction, and a non-twisted crimped part having no twist, which are alternately disposed along a longitudinal direction of the yarn, wherein an average length of the non-untwisted part is 7 mm or less, an average length of the over-untwisted part is 7 mm or more, and a degree of fusion-bonding in the longitudinal direction of the yarn is 50% or less.

It is preferable that the average length of the non-untwisted part is 1 mm or more. It is preferable that the average length of the over-untwisted part is 40 mm or less.

It is preferable that a water absorption height is 10 mm to 50 mm.

It is preferable that a porosity of a cross section of the non-untwisted part is 10% to 70%. It is more preferable that the porosity is 20% to 40%.

We also provide a multilayer-structure woven or knitted fabric having a top face and a back face, the top face being made from a false-twisted low-fused polyester yarn comprising a non-untwisted part having a twist in a false-twist direction, an over-untwisted part having a twist in a direction opposite to the false-twist direction, and a non-twisted crimped part having no twist, which are alternately disposed along a longitudinal direction of the yarn, wherein an average length of the non-untwisted part is 7 mm or less, an average length of the over-untwisted part is 7 mm or more, and a degree of fusion-bonding in the longitudinal direction of the yarn is 50% or less, the back face being made from a fiber having a water absorption height less than that of the false-twisted low-fused polyester yarn.

It is preferable that the false-twisted low-fused polyester yarn is disposed in a network on the top face, while the fiber having the water absorption height less than that of the false-twisted low-fused polyester yarn is disposed at another part on the top face.

To give a plain texture to the top face, it is possible that the multilayer-structure woven or knitted fabric has a back layer or a middle layer of the fabric comprising the false-twisted low-fused polyester yarn (false-twisted low-fused polyester yarn comprising a non-untwisted part having a twist in a false-twist direction, an over-untwisted part having a twist in a direction opposite to the false-twist direction, and a non-twisted crimped part having no twist, which are alternately disposed along a longitudinal direction of the yarn, wherein an average length of the non-untwisted part is 7 mm or less, an average length of the over-untwisted part is 7 mm or more, and a degree of fusion-bonding in the longitudinal direction of the yarn is 50% or less). It is preferable that a fiber having the water absorption height less than that of the false-twisted low-fused polyester yarn is disposed on the top face.

If the multilayer-structure woven or knitted fabric is configured as a knitted fabric, it is preferable that a fiber area per unit area is 90% or more and an air permeability is 150 cc/cm2/sec or more, preferably 200 cc/cm2/sec or more.

If the multilayer-structure woven or knitted fabric is configured as a woven fabric, it is preferable that a fiber area per unit area is 90% or more and an air permeability is 100 cc/cm2/sec or more.

A material for summer items, which are mostly white or light-colored products, is required to suppress a transparency. It is preferable that the fabric has an anti-transparency of 80% or more.

To impart an ultraviolet shielding function to the woven or knitted fabric, it is preferable that an ultraviolet shielding rate of a white fabric is 90% or more and a UPF is 30 or more.

Our false-twisted low-fused polyester yarns make it possible to provide a woven or knitted fabric or the like having a high water absorbability for quick-drying and breathability while a soft material having unique surface texture can be provided.

Conventional fused processed yarns can hardly achieve a high water absorbability in a cloth because cross sections of fused parts are squeezed to leave slight voids among single yarns although they can achieve cool texture as well as tension and stiffness. Our false-twisted low-fused polyester yarns can maintain appropriate voids among fibers by reducing the fusion degree as maintaining unspread fiber formation and cross sections deformed with fusion-bonding false-twisting process. With such a fiber formation, a processed yarn having an extremely high water absorbability as well as materials having high breathability can be provided.

EXPLANATION OF SYMBOLS

Figure 1A:
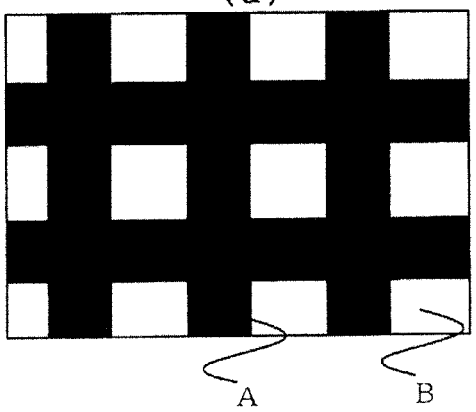
FIG. 1 is a schematic plan view showing a top layer of cloth made with a false-twisted low-fused polyester yarn according to an example, where FIG. 1(*a*) is an example with a checkerboard patterned network structure and FIG. 1(*b*) is another example with a horizontal stripe patterned network structure.

A: high water absorption part (low-fused yarn part)
B: low water absorption part (fiber part having water absorption height of less than that of low-fused yarn)
1: creel
2: 1st feed roller
3: hot pin
4: 2nd feed roller
5: 1st heater
6: false-twister
7: draw roller
8: 2nd heater
9: 3rd feed roller
10: rewind roller
11: creel
12: 2nd feed roller
13: 1st heater
14: false-twister
15: untwisting-promotion guide
16: draw roller
17: 2nd heater
18: 3rd feed roller
19: rewind roller

DETAILED DESCRIPTION

Our false-twisted low-fused polyester yarns are specially-fused false-twisted processed yarns made of a single polyester multifilament comprising a non-untwisted part having a twist in a false-twist direction and an over-untwisted part having a twist in a direction opposite to the false-twist direction.

The false-twisted low-fused yarn is configured to have a formation of the non-untwisted part having the twist in the false-twist direction, the over-untwisted part having the twist in the direction opposite to the false-twist direction, and a non-twisted crimped part having no twist, which are alternately disposed along the longitudinal direction of the yarn. The "alternately disposed" chiefly means alternate yarn formation such as "non-untwisted part, crimped part, over-untwisted part, crimped part, non-untwisted part, crimped part . . . ". It is possible that the non-untwisted part, crimped part or over-untwisted part is partially missing in the alternate yarn formation.

In the formation of the false-twisted low-fused yarn, the non-untwisted part has 7 mm or less of an average length. The non-untwisted part is thermally fusion-bonded while the yarn is twisted. The yarn cross section tends to be squeezed to leave almost no space among single yarns. Such a tendency is remarkable especially in a high-fused yarn while the non-untwisted part are long in average and have slight voids among fibers in the cross section to provide a hard processed yarn with tightened yarns. From such a viewpoint, the non-untwisted part having average length of more than 7 mm might cause a poor water absorbability from less voids among fibers to provide a material having a hard texture and strong cool texture. It is preferable that the non-untwisted part has an average length of 1 mm or more. The processed yarn of less than 1 mm might be so uneven in processing that production control is difficult. It is more preferable that the non-untwisted part has an average length of 1 mm to 5 mm. It is preferable that the fused non-untwisted part has a maximum length of 30 mm or less, preferably 20 mm or less. This is because the maximum length of the non-untwisted part even contributes to softness of cloth texture and skin contact while the average length of the non-untwisted part and over-untwisted part contributes to the water absorbability and texture. The over-untwisted part should have an average length of 7 mm or more. Because the number of twists under non-untwisting is balanced out with the over-untwisted part, the over-untwisted part has the less number of twists if the over-untwisted part is longer than the non-untwisted part. Since the yarn is unspread and the cross section is greatly deformed by false-twisting, even an unspread processed yarn has a high water absorbability caused from capillary phenomenon. The proportion of the over-untwisted part has a tendency opposite to the non-untwisted part. The over-untwisted part tends to be longer if the non-untwisted part is shorter. It is preferable that the over-untwisted part has an average length of 40 mm or less because quality might be unstable if the non-untwisted part is too short.

It is important that a yarn longitudinal degree of fusion-bonding is 50% or less. The degree of fusion-bonding represents a proportion of the non-untwisted part. If the average length is 7 mm or less and the degree of fusion-bonding is 50% or less, many fine non-untwisted parts are supposed to exist in the yarn longitudinal direction of processed yarn. It is preferable that the non-untwisted parts exist by 30 to 150 units per 1 m yarn, preferably 50 to 130 units. It is preferable that a yarn longitudinal proportion of the non-untwisted part and the over-untwisted part are 10 to 25% and 75 to 90%, respectively.

To obtain a softer touch in the texture, it is preferable that a degree of fusion-bonding of all yarns is 30% or less.

In the false-twisted low-fused yarn, it is preferable that a water absorption height of fiber is 10 mm or more. Generally, the water absorbability of processed yarns can be evaluated with a water absorption diffusion area determined by the instillation method of woven or knitted fabric made of the fiber or the water absorption height determined by the Byreck method. However, external factors such as woven or knitted fabric stitch and density greatly contribute to the evaluation, so that the potential of fiber water absorbability is not determined easily. The water absorbability of fiber itself has been evaluated to find that the fiber preferably has 10 mm or more of water absorption height to obtain a water absorptive quick-drying material. Although the water absorption height of fiber depends on the water absorption process of woven or knitted fabrics, 10 mm or more of water absorption height of fiber is necessary to achieve a difference of water absorption ability of fiber in a woven or knitted fabric. It is more preferable that the water absorption height of fiber is 20 mm or more, preferably 30 mm or more. With a false-twisted low-fused yarn having a water absorption height of fiber of 10 mm or more, the fabric can be improved in water absorbability for quick-drying relative to a fiber having a water absorption height of less than 10 mm.

In the false-twisted low-fused yarn, the non-untwisted part has a cross section having a porosity of 10% to 70%. Conventional false-twisted yarn has a porosity much greater than 70% because of its crimped formation and therefore it is difficult to achieve 10 mm or more of water absorption height of fiber because of the capillary effect among fibers. Conventional false-twisted yarn has fibers greatly fusion-bonded with each other in non-untwisted parts to leave almost no space among the fibers so that porosity of less than 10% might prevent fibers from absorbing water. Our false-twisted low-fused yarn has a section porosity controlled within 10% to 70% in non-untwisted parts so that intermittent non-untwisted parts are not prevented from absorbing water to improve water absorbability as a whole fiber. If the fiber section porosity is 10% to 70% in the non-untwisted parts, fibers are partially bonded and the fiber formation is unspread to achieve a high breathability of material. It is preferable that a degraded yarn is subjected to measurements of the porosity, average lengths of the non-untwisted part and over-untwisted part and the degree of fusion-bonding. It is possible that a woven or knitted fabric or a yarn to be processed into the fabric is subjected to the measurements in case that it is difficult to measure them without degrading the yarn formation.

It is preferable that the polyester multifilament is a high-oriented undrawn polyester yarn containing inorganic particles of 0.02 to 3.0 mass %. The inorganic particles of less than 0.02 mass % might deteriorate passableness through high-order processing when being spun or false-twisted. The inorganic particles of more than 3.0 mass % might cause troubles such as abrasion of guide or roller in spinning, false-twisting or a higher order processing. The inorganic particle may be silicon oxide, titanium oxide, alumina or the like. The titanium oxide is particularly preferable from viewpoints of stainability, texture, passableness through postprocessing or the like.

It is preferable that the high-oriented undrawn polyester yarn has a birefringent rate of 0.02 to 0.07. Such a range is appropriate from viewpoints of drawing and orientation adjustment in a fusion-bonding process.

To achieve low-fusion, it is preferable that a drawing process called "out draw" with hot pin is performed by a ratio capable of causing uneven draw and then a simultaneous drawing and false-twisting process called "in draw" is performed by a low draw ratio. The uneven draw means a method of drawing an undrawn yarn in a constant draw region to design thick yarn parts and thin yarn parts inside the yarn. The thick yarn part has a melting point lower than that of the thin yarn part so that fibers tend to be fusion-bonded with each other in a false-twisting process. Such a method to control the fusion-bonding to prepare a fused-yarn can stably provide a high-quality material having good cloth surface and soft texture in which non-untwisted parts are segmentalized by a stably low proportion of the non-untwisted part in comparison with conventional yarns.

To further achieve the soft texture of cloth, it is preferable that the fabric has a single yarn fineness of 0.5 dtex to 2.6 dtex. The single yarn fineness of less than 0.5 dtex might cause uneven fusion-bonding or fluff to deteriorate the quality required for low-fusing process. The single yarn fineness of more than 2.6 dtex might cause rather hard texture which is not appropriate for softness of underwear and sportswear for ladies. It is more preferable that the single yarn fineness is 0.5 dtex to 1.4 dtex.

The out draw drawing can be performed in an appropriate condition for uneven draw designed according to characteristics such as elongation of undrawn yarn called POY.

Although depending on elongation or physical properties of the POY, it is preferable that the POY having a natural draw ratio (NDR) of 5 to 40% is drawn by an appropriate out-draw ratio and an in-draw ratio of 0.9 to 1.3 to prepare a desirable low-fused processed yarn. Low tension is applied when twisted and untwisted so that filaments are thermally fusion-bonded in a false-twisting heater appropriately while untwisting is promoted to decrease non-untwisted parts in a twisting direction and increase over-untwisted parts in a untwisting direction. The in-draw ratio of more than 1.3 might cause excessive tension in twisting and untwisting, so that untwisted fused parts are hardly formed in short cycle. The draw ratio of less than 0.9 might cause a high fusion-bonding to increase the non-untwisted parts excessively, and therefore target low-fusion might not be achieved. It is more preferable that the draw ratio is 1.0 to 1.2. The drawing process is preferably performed in such a range although desirable tension in twisting and untwisting depends on the employed fiber.

The hot pin used in the out draw may be of pin type to rewind the yarn, round type to contact a semicircle, short heater type shaped in a plate, non-contact type or the like. It is preferable that a contact type heater is controlled from 60° C. to 110° C. to perform the draw.

The number of twists (T [t/m]) of false-twisting for the drawing and false-twisting process satisfies the following formula: $8{,}000/D^{1/2} \leq T \leq 30{,}000/D^{1/2}$. The less the number of twists of false-twisting is the weaker the degree of fusion-bonding is so that sufficient water absorbability and breathability cannot be achieved because of loose twisted parts in the false-twisting direction and untwisting direction. The excessive number of twists of false-twisting might not control the quality stably in processing.

The temperature of the false-twisting heater of contact type may be set at 220° C. to 245° C. at 300 m/min of processing speed for polyethylene terephthalate. The temperature of less than 220° C. might deteriorate the degree of fusion-bonding to cause insufficient fusion-bonding, although the desirable temperature depends on melting point of processed yarn, processing speed and heater type. The temperature of more than 245° C. might increase the degree of fusion-bonding among filaments to form a yarn having rough hard texture. The preferable range of the temperature of false-twisting greatly depends on the heater and processing speed and therefore cannot be determined specifically.

The false-twisting process is performed with a false-twister which may be of pin type, belt nip type, friction type or the like, and be of either 1-heater processing type or 2-heater processing type. To stably produce processed yarns having desirable low-fused formation, it is preferable that the false-twisting process is performed while a tension applied to the twisted part or untwisted part is stably adjusted. From a viewpoint of tension control, the belt nip type false-twister is employed preferably.

It is preferable that a woven or knitted fabric has a multilayer-structure having a top layer of cloth partially comprising the false-twisted low-fused yarn and a back layer (skin side) comprising a fiber having a water absorption height less than that of the false-twisted low-fused yarn. It is preferable that the water absorption height of the false-twisted low-fused yarn which partially composes the top layer is at least 1.2 times as high as that of the fiber which partially composes the back layer. Such a configuration can provide excellent performance in absorbability and permeability of water to transfer the sweat absorbed from the back layer at the skin side of a knitted cloth, as well as diffusion, transpiration and quick-drying of the top layer of the knitted cloth, so that a comfortable wear can be achieved with less sticky texture even in case of much sweating.

It is more preferable that the woven or knitted fabric has a structure excellent in such water absorbability that a water retention rate ratio of top/back water absorption of the top layer to the back layer of woven or knitted cloth is 2 or more while a diffusion area ratio of top/back water absorption is 2 or more. It is more preferable that the diffusion area ratio of top/back water absorption is 3 or more.

Figure 1B:
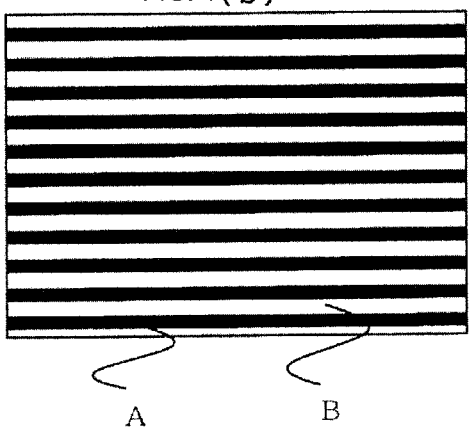

To achieve further higher water absorbability for quick-drying, provided is a multilayer-structure woven or knitted fabric configured to have a special top face structure that the false-twisted low-fused yarns are disposed like a network on the top face while fibers having a water absorption height less than that of the false-twisted low-fused yarn are disposed at the other parts on the top face of cloth. With such a configuration, the diffusion area can be made greater on the top layer because sweat is transferred by the top/back structure of woven or knitted fabric while the sweat is preferentially transferred to the false-twisted low-fused yarns having higher water absorbability in the top layer and the sweat is secondly transferred to the fibers having lower water absorbability than that of the fused yarns in the top layer. Such a diffusion of the sweat in the top layer makes it possible to highly achieve a quick-drying performance. FIG. 1 shows an example of the network structure in the top layer. The top layer structure of woven or knitted fabric had better be made of fused yarns partially by some content rather than 100% to achieve more effective result. The network may be achieved by not only designing a woven or knitted fabric but also mixing the fused yarn with less water-absorbable fiber to be woven or knitted, or be processed into mixed core/sheath processed yarns.

Conventional fused yarns have characteristics such as surface texture of grain (unevenness or crimp on the surface) or different dyeing and touch of cool texture. Such characteristic have been reduced in our fabric to exhibit flat surface texture and soft texture in comparison with conventional fused processed yarn. Thus our fabric can be used for sportswear clothes and underwears. With the above-described multilayer-structure and the top layer network structure, unnecessary characteristics, such as grain and different dyeing of conventional fused-yarn fabric, can be reduced even in the sportswears and underwears.

Thus, our false-twisted low-fused yarn can reduce the surface texture of grain or different dyeing and touch of cool texture. To achieve a plain surface texture that even ordinary false-twisted yarns achieve, our false-twisted low-fused yarn can be disposed in the back layer or middle layer behind the top face of a fabric having a multilayer-structure. Our false-twisted low-fused yarn is soft enough to softly contact skin even when the fused yarn is disposed on the back face of fabric that tends to contact the skin. Since our yarn has both thick and thin parts as well as crimped formation and twisted yarn formation to exhibit good water absorbability, it can easily unstick from sweaty skin with less adhesion. As described above, a fiber disposed on the top face has preferably a water absorption height higher than that of a fiber disposed on the back face. However, a false-twisted low-fused yarn has a good enough water absorbability so that the water retention rate ratio and diffusion area ratio of the top and back side of fabric cannot easily be satisfied if our yarn is disposed on the back side. In such a case, it is preferable to adjust the composition, density or employed yarn of the woven or knitted fabric to have a structure such that a water retention rate ratio of top/back water absorption of the top layer to the back layer of woven or knitted cloth is 2 or more while a diffusion area ratio of top/back water absorption is 2 or more. It is more preferable that the diffusion area ratio of top/back water absorption is 3 or more.

Our multilayer-structure woven or knitted fabric comprising at least two layers of top layer and back layer (skin side) may have any stitch. For a circular knitted fabric, the stitch may be single jersey or double jersey. For a warp knitted fabric, it may be single tricot, double tricot, single raschel or double raschel. For a weft knitted fabric, it may be single velvet knit or double velvet knit. For woven fabric, it may be twill, satin, various double stitches or modified stitch thereof.

The back layer (skin side) is preferably shaped into an uneven surface having many dispersed salients rather than a flat surface. Such an uneven surface of the back layer (skin side) makes it possible that the salient of clothes is brought into point-contact with skin so that the sticky feeling can be reduced. The uneven surface may have a pattern such as vertical stripe, horizontal stripe, checker, twill, herringbone, dot and dapple. Such an uneven difference in height can be formed by employing appropriate fabric stitch or appropriate mixture of thick yarns and thin yarns, or combining thereof.

When the multilayer-structure fabric is required to have stretch properties, it is preferable that yarns are interknitted, wherein the yarn may be stretchy elastic yarn such as polyurethane-based elastic yarn, polyester-based yarn such as polybutylene terephthalate-based processed yarn and polytrimethylene terephthalate-based processed yarn, or a side-by-side type composite yarn made from polyethylene terephthalate polymer and polytrimethylene terephthalate polymer. From a viewpoint of water absorbability, it is preferable that the stretchy yarn is disposed in the back layer or the middle layer.

The false-twisted low-fused yarn can provide a material excellent in breathability and quality of the top face. Our false-twisted low-fused yarn has a unique fiber structure to provide a woven or knitted fabric with a high breathability. The breathability depends on the proportion of the false-twisted low-fused yarn on the top face of cloth partially made with the false-twisted low-fused yarn. It can provide a knitted fabric having 90% or more of fiber area per unit area and 150 $cc/cm^2/sec$ or more of air permeability, as well as a woven fabric having 90% or more of fiber area per unit area and 100 $cc/cm^2/sec$ or more of air permeability. Thus the false-twisted low-fused yarn can provide a woven or knitted fabric with excellent breathability that depends on each structure. Even a fabric comprising no stitch pattern such as mesh stitch, of small fiber area per unit area can achieve 150 $cc/cm^2/sec$ or more of air permeability for the knitted fabric, as well as 100 $cc/cm^2/sec$ or more of air permeability for the woven fabric.

EXAMPLES

Hereinafter, our yarns and fabrics will be explained concretely with reference to Examples and Comparative Examples. Physical properties of false-twisted low-fused polyester yarns and woven or knitted fabrics are measured and evaluated by the following methods.

(1) Average Length of Non-Untwisted Part and Over-Untwisted Part

A side of yarn is observed with "microscope VHX-2000" made by Keyence Corporation to measure lengths per 1 m yarn of non-twisted parts and over-untwisted parts to determine average lengths.

(2) Degree of Fusion-Bonding in Fiber longitudinal Direction

A section of yarn is observed with a scanning electron microscope (S-3400N made by Hitachi High-Technologies Corporation) to determine to be a fusion-bonded section if the proportion of single yarns fusion-bonded to adjacent single yarn is 50% or more in the section. Such a deteimination is performed in randomly chosen 20 sections, and then a degree of fusion-bonding is calculated with the formula of (the number of determined fusion-bonded sections/20)×100.

(3) Absorption Height of Fiber

A measurement is performed by reference to JIS-L-1907 (Byreck Method) with 400 mm of degraded yarn obtained from a fabric subjected to a water absorbing process. Concretely, load of 0.005 cN/dtex is applied to the lower end of fiber while the upper end is fixed to immerse the lower end by 20 mm±2 mm. 10 minutes later, a height of raised water in the fiber is measured. 10 samples are measured by this method to calculate an average value. For a woven or knitted fabric such as tricot from which degraded yarns are hardly picked up, it is possible that the processed yarn is knitted tubularly to give water absorbability so that the water absorption height of degraded yarn obtained from the tubularly knitted yarn is measured. To give water absorbability to the tubularly knitted yarn made of polyethylene terephthalate or the like, it is possible that 3% owf of TO-SR-1 (made by Takamatsu Oil & Fat Co., Ltd.) and 0.1% owf of navy-blue dispersion dye and dyeing aid are added to be processed at 130° C. for 30 minutes.

(4) Porosity of Non-Untwisted Part

A fiber cross section of non-untwisted part of woven or knitted fabric made of fusion-bonded processed yarn is observed with a scanning electron microscope to measure a proportion of fiber and void per area of circumscribed circle of the fiber bundle section, a porosity is calculated from average values of 10 samples.

(5) Air Permeability

An air permeability is determined according to JIS L-1096 (Frazier type method).

(6) Fiber Area Per Unit Area

A proportion of fiber area in 2 cm×2 cm size is measured with "microscope VHX-2000" made by Keyence Corporation.

(7) Water Retention Rate Ratio of Top/Back Water Absorption

Distilled water of 1.0 cc is dropped on a glass plate and then a knitted cloth of 10 cm×10 cm size is placed on it so that the back face contacts the distilled water below. After being left for 60 seconds, the knitted fabric is transferred onto another glass plate and sandwiched between filter papers of the same size. Load of 5 g/m$^2$ is applied to it for 60 seconds. The weight including absorbed water is subtracted from the original weight of the knitted fabric to calculate a water retention. Also, a water retention rate of the top and back faces are calculated from the wet weight of each filter paper contacted to the top and back face. Such operations are performed with three samples of knitted fabrics to calculate a water retention rate ratio (top face water retention rate/back face water retention rate).

The water retention rate ratio represents absorption condition of distilled water. A fabric having a great water retention rate ratio as well as great water retention rate on the top face can transfer dropped distilled water efficiently to the top face side, so that excellent water permeability is achieved with less sticky feeling of clothes.

(8) Diffusion Area Ratio of Top/Back Water Absorption

Commercially available ink diluted twice of 1.0 cc is dropped on a glass plate and then a knitted cloth is placed on it so that the back face contacts the diluted ink. After being left for 60 seconds to absorb the diluted ink, the knitted fabric is transferred onto another glass plate and left for 3 minutes. Such operations are performed with three samples of knitted fabrics to measure diffusion areas of the diluted ink on the top and back faces of the knitted fabrics to calculate a diffusion area ratio (top face diffusion area/back face diffusion area).

The diffusion area represents absorption condition of the diluted ink. A fabric having a great diffusion area ratio as well as great diffusion area on the top face can transfer dropped diluted ink efficiently to the top face side, so that excellent water absorbability, water permeability and diffusibility are achieved.

(9) Surface Quality and Texture

A surface quality and texture are evaluated into three grades with sensory evaluation by five experts.

Surface Quality

○: good

Δ: acceptable

X: bad

Texture

○: soft

Δ: slightly hard

X: husky, hard

(10) Anti-Transparency

A white cloth sample is prepared by the same method as product fabrics, except that a dyeing process is performed without dye. L* level (Lw1) of white plate attached to the sample back face and L* level (Lb1) of black plate attached to the sample back face are measured with CM-3600d made by Minolta Co., Ltd. Also, L* level (Lw) of the white plate and L* level (Lb) of the black plate without the sample are measured to calculate an anti-transparency by the following formula.

$$\text{Anti-transparency}[\%]=100-(Lw1-Lb1)/(Lw-Lb)\times 100$$

(11) UPF Level

A white cloth sample is prepared by the same method as product fabrics, except that a dyeing process is performed without dye. A transmissivity [%] of the sample piece is measured with a spectrophotometer by irradiating ultraviolet of 290-400 nm to calculate a UPF level. The measurement is performed at five positions of the sample to calculate an average value among three positions excepting the maximum and the minimum values. The average value is regarded as a UPF level of the fabric. Besides, a fluorescence-cut filter (Toshiba UV-D33S) is used when a fluorescence-whitening processed cloth is employed.

(12) Proportion of Fusion-Bonding in Fiber Longitudinal Direction

A side of yarn is observed with "microscope VHX-2000" made by Keyence Corporation to measure a proportion of non-twisted fused part length per 1 m yarn. The proportion [%] is regarded as a proportion of fusion-bonding. The non-twisted fused part can be identified by the twisted yarn formation which is firm at the non-untwisted part and which is loose at the over-untwisted part.

Example 1

Figure 2:
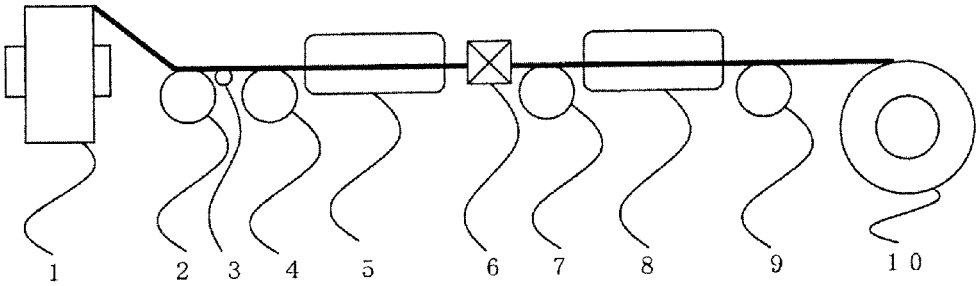
FIG. 2 is a schematic flow diagram showing an example of manufacturing process of the false-twisted low-fused polyester yarn.
Figure 3:
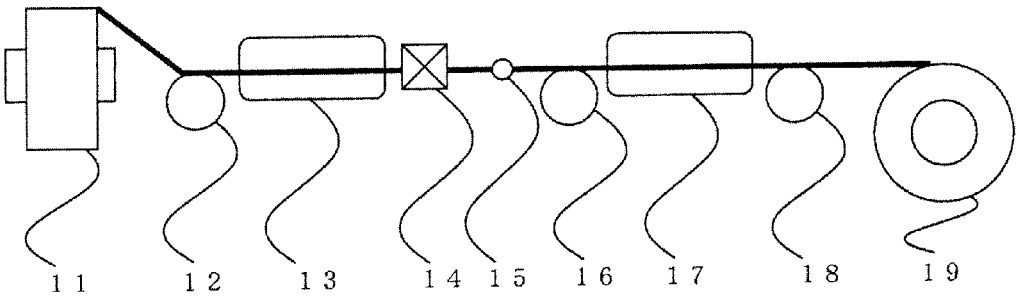
FIG. 3 is a schematic flow diagram showing a manufacturing process of a false-twisted low-fused polyester yarn according to a comparative example.

Polyethylene terephthalate was melt-spun at 2,700 m/min of speed to prepare an undrawn yarn having a circular cross section of 140 dtex and 36 filaments, supposed to elongate to be 84 dtex and 36 filaments of single fibers. Inorganic particles, chiefly made of titanium oxide, were added by 0.3 mass %. Thus prepared undrawn yarn having a circular cross section was processed into a false-twisted low-fused yarn of 100 dtex under the condition shown in Table 1 according to the processes shown in FIG. 2. The false-twisted low-fused yarn was found to comprise non-untwisted parts, crimped parts having substantially no twist, and over-untwisted parts having twists in the untwisting direction of false-twisting. Table 2 shows measurement results of physical properties of the false-twisted low-fused yarn.

TABLE 1

| Level | Example 1 | Example 2 | Example 3 | Example 4 | Example 5 | Example 6 | Example 7 | Comparative Example 1 | Comparative Example 2 | Comparative Example 3 | Comparative Example 4 |
|---|---|---|---|---|---|---|---|---|---|---|---|
| 1st feeding roller speed [m/min] | 258 | 258 | 258 | 308 | 258 | 258 | 258 | — | 308 | — | 305 |
| Hot pin temperature [° C.] | 90 | 90 | 90 | 90 | 90 | 90 | 90 | — | 90 | — | 80 |
| 2nd feeding roller speed [m/min] | 364 | 364 | 364 | 364 | 364 | 370 | 370 | 235 | 364 | 296 | 396 |
| 1st heater temperature [° C.] | 238 | 238 | 230 | 230 | 238 | 235 | 235 | 210 | 245 | 245 | 240 |
| The number of false twists | 2,800 | 2,800 | 2,800 | 2,800 | 2,800 | 2,800 | 2,800 | 2800 | 2,800 | 4,800 | 2,800 |
| Draw roller speed [m/min] | 400 | 400 | 400 | 400 | 400 | 400 | 400 | 400 | 400 | 450 | 400 |

TABLE 2

| Level | Example 1 | Example 2 | Example 3 | Example 4 | Example 5 | Example 6 | Example 7 | Comparative Example 1 | Comparative Example 2 | Comparative Example 3 | Comparative Example 4 |
|---|---|---|---|---|---|---|---|---|---|---|---|
| Average length of untwisted part [mm] | 4.8 | 5.4 | 3.5 | 4.8 | 4.8 | 4.7 | 4.7 | 0.0 | 11.6 | 2.9 | 8.8 |
| Average length of over-untwisted part [mm] | 9.6 | 8.3 | 16.4 | 9.6 | 9.6 | 9.8 | 9.8 | 0.0 | 4.2 | 4.3 | 6.8 |
| Fiber longitudinal fusion-bond degree | 25 | 40 | 15 | 35 | 35 | 20 | 20 | 0 | 65 | 35 | 45 |
| Fiber longitudinal fusion-bond rate [%] | 18 | 23 | 18 | 18 | 18 | 24 | 24 | 0 | 42 | 29 | 33 |
| Untwisted part porosity [%] | 15 | 10 | 32 | 15 | 15 | 47 | 47 | — | 7 | 8 | 8 |
| Water absorption height of fiber [mm] | 19 | 21 | 18 | 15 | 19 | 39 | 39 | 5 | 8 | 8 | 18 |
| Fiber area per unit area [%] | 96 | 93 | 96 | 98 | 93 | 94 | 94 | 93 | 88 | 91 | 85 |
| Air permeability [cc/cm$^2$/sec] | 212 | 255 | 201 | 133 | 289 | 221 | 267 | 135 | 248 | 232 | 264 |
| Water retention rate ratio of top/back | 4.0 | 5.3 | 3.6 | 9.6 | 2.8 | 8.4 | 8.4 | 1.6 | 3.2 | 2.4 | 3.4 |
| Diffusion area ratio | 14.3 | 14.5 | 12.7 | 7.8 | 8.2 | 14.5 | 12.5 | 5.9 | 8.8 | 6.3 | 9.0 |
| Texture | Δ: slightly hard | Δ: slightly hard | ○: soft | ○: soft | Δ: slightly hard | ○: soft | ○: soft | ○: soft | x: husky, hard | ○: soft | Δ: slightly hard |
| Surface | ○: good | ○: good | Δ: acceptable | ○: good | ○: good | ○: good | ○: good | ○: good | x: bad | Δ: acceptable | x: bad |
| Anti-transparency | 87 | 88 | 89 | 84 | 84 | 92 | 90 | 89 | 82 | 84 | 83 |
| UPF | 34 | 31 | 38 | 30 | 31 | 40 | 35 | 34 | 27 | 28 | 27 |

As shown in FIG. 1 (*a*), the false-twisted low-fused yarn was used to make low-fused yarn part A in the top layer to produce a circular knitted fabric of which top face had network structure like a checkerboard pattern. Fiber parts B having low height of water absorption on the top layer were made of false-twisted mixed yarns (CEO α made by Toray Industries, Inc.) having circular and octagonal cross sections of 84 dtex and 48 filaments. The back layer was made of a 2-heater false-twisted yarn having a circular cross section of 84 dtex and 36 filaments. The circular knitted fabric was processed by ordinary processes for dyeing and giving a water absorbability. Thus obtained knitted fabric was excellent in surface texture with dry feeling as well as soft touch.

Example 2

A circular knitted fabric was produced by the same method as Example 1, except that the other yarn of the false-twisted low-fused yarn on the top layer was replaced by a low-fused yarn similarly prepared from an undrawn yarn having a circular cross section of 84 dtex and 72 filaments.

Example 3

Under conditions shown in Table 1, a false-twisted low-fused yarn of 100 dtex was prepared from the same undrawn yarn as Example 1. A knitted fabric was produced from thus prepared false-twisted low-fused yarn by the same method as Example 1.

Example 4

To produce a multiple woven fabric having low-fused yarn part A and fiber parts B having low water absorption height with altered interval of horizontal stripe pattern as shown in FIG. 1 (*b*), the same false-twisted low-fused yarn as Example 1 was employed to make low-fused yarn part A while a cation-dyeable yarn of 56 dtex and 72 filaments was employed to make fiber parts B having low water absorption height. A cation-dyeable yarn of 84 dtex and 24 filaments was employed as the weft yarn to be mostly disposed on the back side while a 300 T/m of furthertwisted yarn of mixed false-twisted yarns having circular and octagonal cross sections of 84 dtex and 48 filaments was employed as the warp yarn.

Example 5

A plain stitch woven fabric was produced by alternately using the same false-twisted low-fused yarn as Example 1 and the mixed yarns having circular and octagonal cross sections of 84 dtex and 48 filaments.

Example 6

Polyethylene terephthalate was melt-spun at 2,700 m/min of speed to prepare an undrawn yarn having a circular cross section of 93 dtex and 72 filaments, supposed to elongate to be 56 dtex and 72 filaments of single fibers. Inorganic particles, chiefly made of titanium oxide, were added by 2.2 mass %. Thus prepared undrawn yarn having a circular cross section was processed into a false-twisted low-fused yarn of 61 dtex under the condition shown in Table 1 according to the processes shown in FIG. 2. The false-twisted low-fused yarn was found to comprise non-untwisted parts, crimped parts having substantially no twist, and over-untwisted parts having twists in the untwisting direction of false-twisting. Table 2 shows measurement results of physical properties of the false-twisted low-fused yarn.

Similarly to Example 1, the false-twisted low-fused yarn was used to make low-fused yarn part A in the top layer to produce a reversible circular knitted fabric of which top face had network structure like a checkerboard pattern. Fiber parts B having low height of water absorption on the top layer were made of a false-twisted yarn (LOC II made by Toray Industries, Inc.) having a circular cross section of 56 dtex and 48 filaments. The back layer was made of a 2-heater false-twisted yarn having a circular cross section of 56 dtex and 36 filaments with mesh-stitch. The circular knitted fabric was processed by ordinary processes for cation-dyeing and giving a water absorbability with disperse dye. Thus obtained knitted fabric was excellent in unique surface texture with dry feeling as well as soft touch. Even a white cloth was excellent in anti-transparency.

Example 7

The same false-twisted low-fused yarn as Example 6 was disposed on the back face with mesh stitch while a false-twisted yarn made of polyethylene terephthalate having a circular cross section of 56 dtex and 96 filaments was disposed on the top face with flat all knit. The false-twisted low-fused yarn didn't appear on the surface of the fabric having a surface texture like a false-twisted yarn with soft and dry touch on the skin side.

Comparative Example 1

A knitted fabric was produced by the same method as Example 1, except that the false-twisted low-fused yarn was replaced by conventional false-twisted 2-heater processed yarn of 84 dtex and 36 filaments.

Comparative Example 2

A high-fused yarn having a high degree of fusion-bonding was prepared from the same undrawn yarn as Example 1. A knitted fabric was produced by the same method as Example 1, except that the false-twisted low-fused yarn employed in Example 1 was replaced by the high-fused yarn.

Comparative Example 3

Polyethylene terephthalate was melt-spun at 2,700 m/min of speed to prepare an undrawn yarn of 61 dtex and 24 filaments, supposed to elongate to be 33 dtex and 24 filaments of single fibers. Thus prepared undrawn yarn was processed into a false-twisted fused yarn under the condition shown in Table 1 according to the processes shown in FIG. 2. The false-twisted fused yarn was a material having uneven texture of grain among processed yarns with low water absorbability for quick-drying and grain stronger than that of the circular knitted fabric produced in Example 1 that had soft texture with less grain.

Comparative Example 4

Polyethylene terephthalate was spun at 3,200 m/min of speed to prepare a high-oriented undrawn yarn of 125 denier, 36 filaments and 40% of natural draw ratio (NDR). Thus prepared raw yarn was drawn at 80° C. by 1.3 of draw ratio as contacting a hot pin by 60 mm of contact length, and then was false-twisted at 400 m/min of yarn speed by 1% of false-twisting feed rate at 240° C. of 1st heater temperature to be subjected to a heat-setting process for preventing yarns from frizzling caused by residual torque with 2nd heater at 200° C.

Thus obtained processed yarn was woven by plain stitch at warp density of 89 pieces/inch and weft density of 70 pieces/inch and was dyed to be finished. Thus produced woven fabric had hard touch and visually hard texture with grain and apparently dyed grain on the surface.

INDUSTRIAL APPLICATIONS

A false-twisted low-fused polyester yarn is applicable to provide a woven or knitted fabric having a high water absorbability for quick drying as well as breathability.

The invention claimed is:

1. A false-twisted low-fused polyester yarn comprising:

a non-untwisted part having a twist in a false-twist direction;

an over-untwisted part having a twist in a direction opposite to the false-twist direction; and a non-twisted crimped part having no twist, wherein the parts are alternately disposed along a longitudinal direction of the yarn, an average length of the non-untwisted part is 7 mm or less, an average length of the over-untwisted part is 7 mm or more, a degree of fusion-bonding in the longitudinal direction of the yarn is 50% or less, and a porosity of a cross section of the non-untwisted part is 10% to 47%.

2. The false-twisted low-fused polyester yarn according to claim 1, wherein a water absorption height is 10 mm to 50 mm.

3. The false-twisted low-fused polyester yarn according to claim 1, wherein the porosity is 10% to 40%.

4. The false-twisted low-fused polyester yarn according to claim 1, wherein the average length of the non-untwisted part is 1 mm or more.

5. The false-twisted low-fused polyester yarn according to claim 1, wherein the average length of the over-untwisted part is 40 mm or less.

6. A multilayer-structure woven or knitted fabric comprising:

a top face made from the false-twisted low-fused polyester yarn according to claim 1; and a back face made from a fiber having a water absorption height less than that of the false-twisted low-fused polyester yarn.

7. The multilayer-structure woven or knitted fabric according to claim 6, wherein the false-twisted low-fused polyester yarn is disposed in a network on the top face, while the fiber having the water absorption height less than that of the false-twisted low-fused polyester yarn is disposed at another part on the top face.

8. A multilayer-structure woven or knitted fabric comprising a back layer or a middle layer of the fabric comprising the false-twisted low-fused polyester yarn according to claim 1.

9. The multilayer-structure woven or knitted fabric according to claim 6, wherein the fabric is a knitted fabric, and a fiber area per unit area is 90% or more and an air permeability is 150 cc/cm$^2$/sec or more.

10. The multilayer-structure woven or knitted fabric according to claim 6, wherein the fabric is a woven fabric, and a fiber area per unit area is 90% or more and an air permeability is 100 cc/cm$^2$/sec or more.

11. The multilayer-structure woven or knitted fabric according to claim 6, wherein anti-transparency of a white fabric is 80% or more and an Ultraviolet Protection Factor (UPF) of the multilayer-structure woven or knitted fabric is 30 or more.

12. The false-twisted low-fused polyester yarn according to claim 2, wherein a porosity of a cross-section of the non-untwisted part is 10% to 70%.

13. The false-twisted low-fused polyester yarn according to claim 2, wherein the average length of the non-untwisted part is 1 mm or more.

14. The false-twisted low-fused polyester yarn according to claim 3, wherein the average length of the non-untwisted part is 1 mm or more.

15. The false-twisted low-fused polyester yarn according to claim 2, wherein the average length of the over-untwisted part is 40 mm or less.

16. The false-twisted low-fused polyester yarn according to claim 3, wherein the average length of the over-untwisted part is 40 mm or less.

17. The false-twisted low-fused polyester yarn according to claim 4, wherein the average length of the over-untwisted part is 40 mm or less.

* * * * *